US008156775B2

(12) United States Patent
Yamaguchi et al.

(10) Patent No.: US 8,156,775 B2
(45) Date of Patent: Apr. 17, 2012

(54) CYLINDER LOCK, CLUTCH DEVICE AND UNLOCKING DEVICE COMPRISING THEREOF

(75) Inventors: Jun Yamaguchi, Aichi (JP); Takumi Tamezane, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 278 days.

(21) Appl. No.: 12/177,688

(22) Filed: Jul. 22, 2008

(65) Prior Publication Data

US 2009/0031768 A1 Feb. 5, 2009

(30) Foreign Application Priority Data

Jul. 30, 2007 (JP) ..... 2007-197615

(51) Int. Cl.
*E05B 27/00* (2006.01)

(52) U.S. Cl. ..... 70/357; 70/369; 70/379 R

(58) Field of Classification Search ..... 70/379 R, 70/357, 360, 369, 182
See application file for complete search history.

(56) References Cited

U.S. PATENT DOCUMENTS

| | | | | |
|---|---|---|---|---|
| 4,262,507 | A * | 4/1981 | Flack et al. | 70/432 |
| 5,640,864 | A * | 6/1997 | Miyamoto | 70/379 R |
| 5,732,580 | A * | 3/1998 | Garnault et al. | 70/422 |
| 6,711,924 | B2 * | 3/2004 | Ritz | 70/422 |
| 6,938,446 | B2 | 9/2005 | Fukunaga et al. | |
| 2007/0209412 | A1 * | 9/2007 | Shiramizu et al. | 70/276 |

FOREIGN PATENT DOCUMENTS

JP 2002-129805 A 5/2002

* cited by examiner

*Primary Examiner* — Kristina Fulton
(74) *Attorney, Agent, or Firm* — Roberts Mlotkowski Safran & Cole P.C.

(57) ABSTRACT

A cylinder lock includes a sleeve, and a key plug housed in the sleeve and having an output portion to output an interrupted motion of a clutch device by moving in an insertion and extraction direction by an insertion and extraction of a matching key. The key plug is formed by a pivoting spindle in which the output portion pivotally supports an input clutch element and an output clutch element of the clutch device in the output state by an insertion of the matching key.

8 Claims, 12 Drawing Sheets

(a)

(b)

(a)

(b)

CYLINDER LOCK, CLUTCH DEVICE AND UNLOCKING DEVICE COMPRISING THEREOF

BACKGROUND OF THE INVENTION

1. Field of the Invention

The present invention relates to a cylinder lock, a clutch device and un unlocking device comprising thereof, in more particular, to a cylinder lock, a clutch device and un unlocking device comprising thereof to unlock a door locking mechanism in a vehicle door panel.

2. Related Art

For example, there is a conventional locking and unlocking device comprising a clutch (a link mechanism for actuator) intermitting by a pivotal operation of a regular key (a matching key) (JP-A 2002-129805).

This locking and unlocking device comprises a link mechanism for handle which produces a pivotal movement by a handle extraction operation, a rod for handle which produces a descending linear motion by the pivotal movement of the link mechanism for handle, and a coupling lever mechanism which transmits the linear motion of the rod for handle to the above-mentioned link mechanism for actuator.

Furthermore, this locking and unlocking device comprises a cylinder lock housed in a handle with a rotor pivoting by an insertion pivotal operation of the matching key, a rod for cylinder lock pivoting by a pivotal movement of the rotor of the cylinder lock, and a key lever mechanism transmitting the pivotal movement of the rod for the cylinder lock to the above-mentioned link mechanism for actuator.

In such a locking and unlocking device, when the rotor pivots in one direction from a neutral position by an insertion pivotal operation of the matching key into the cylinder lock, this pivot movement is transmitted to the key lever mechanism via the rod for cylinder lock, the intermittence of the link mechanism for actuator in a door lock actuator is switched by the operation of the key lever mechanism and the state of the door locking mechanism is changed from unlocking to locking.

When the handle is subsequently operated in a direction to open the door panel, this handle extraction operation is transmitted to the rod for handle via the link mechanism for handle. When the rod for handle moves downwards linearly by the handle extraction operation, the linear motion is transmitted to the link mechanism for actuator via the coupling lever mechanism. When the link mechanism for actuator is activated, since the door locking mechanism is in an unlocking state, the door panel is opened.

Meanwhile, when the rotor pivots in another direction from the neutral position by an insertion pivotal operation of the matching key into the cylinder lock, this pivot movement is transmitted to the key lever mechanism via the rod for cylinder lock, the link mechanism for actuator is activated by the operation of the key lever mechanism and the state of the door locking mechanism is changed from locking to unlocking.

However, in the locking and unlocking device disclosed by JP-A 2002-129805, since a rod for cylinder lock and a key lever mechanism are also provided other than a clutch, a cylinder lock and a handle, there were problems in that the number of parts assembled increases, the entire structure becomes complicated and the cost also increases.

Furthermore, in the locking and unlocking device disclosed by JP-A 2002-129805, since it has a structure in which the rod for cylinder lock and the key lever mechanism are intermediated between the cylinder lock and the clutch, there were problems in that the outside dimension becomes large and the entire structure grows in size.

THE SUMMARY OF THE INVENTION

Therefore, it is an object of the invention to provide a cylinder lock and a clutch device and an unlocking device comprising thereof by which it is possible to reduce the number of parts assembled resulting in lower costs and miniaturization or simplification of the entire structure.

[1] According to the present invention, a cylinder lock comprising:

a sleeve; and a key plug housed in the sleeve and having an output portion to output an interrupted motion of a clutch device by moving in an insertion and extraction direction by an insertion and extraction of a matching key;

wherein the key plug is formed by a pivoting spindle in which the output portion pivotally supports an input clutch element and an output clutch element of the clutch device in the output state by an insertion of the matching key.

[2] According to the present invention, a clutch device comprising:

a clutch having an input clutch element activated by receiving an operation movement from an operating handle and an output clutch element to output an actuating force from the input clutch element as an unlocking movement of the operating handle in the output state of a cylinder lock by an insertion of the matching key; and a connecting pin which pivotally connects the input clutch element and the output clutch element each other.

[3] According to the present invention, an unlocking device comprising:

a cylinder lock operated by an insertion of a matching key;

an operating handle producing an unlocking movement for unlocking a door locking mechanism; and a clutch device for transmitting the unlocking movement of the operating handle to the door locking mechanism by an operation of the cylinder lock;

wherein the cylinder lock includes:

a sleeve; and a key plug housed in the sleeve and having an output portion to output an interrupted motion of a clutch device by moving in an insertion and extraction direction by an insertion and extraction of a matching key, wherein the key plug is formed by a pivoting spindle in which the output portion pivotally supports an input clutch element and an output clutch element of the clutch device in the output state by an insertion of the matching key, and wherein a clutch device includes;

a clutch having an input clutch element activated by receiving an operation movement from an operating handle and an output clutch element to output an actuating force from the input clutch element as an unlocking movement of the operating handle in the output state of a cylinder lock by an insertion of the matching key; and a connecting pin which pivotally connects the input clutch element and the output clutch element each other.

EFFECT OF THE INVENTION

According to present invention, it is possible to reduce the number of parts assembled and to seek lower costs and miniaturization or simplification of the entire structure.

BRIEF DESCRIPTION OF THE DRAWINGS

Next, the present invention will be explained in more detail in conjunction with appended drawings, wherein.

DESCRIPTION OF THE PREFERRED EMBODIMENTS

Preferred Embodiment

Figure 1:
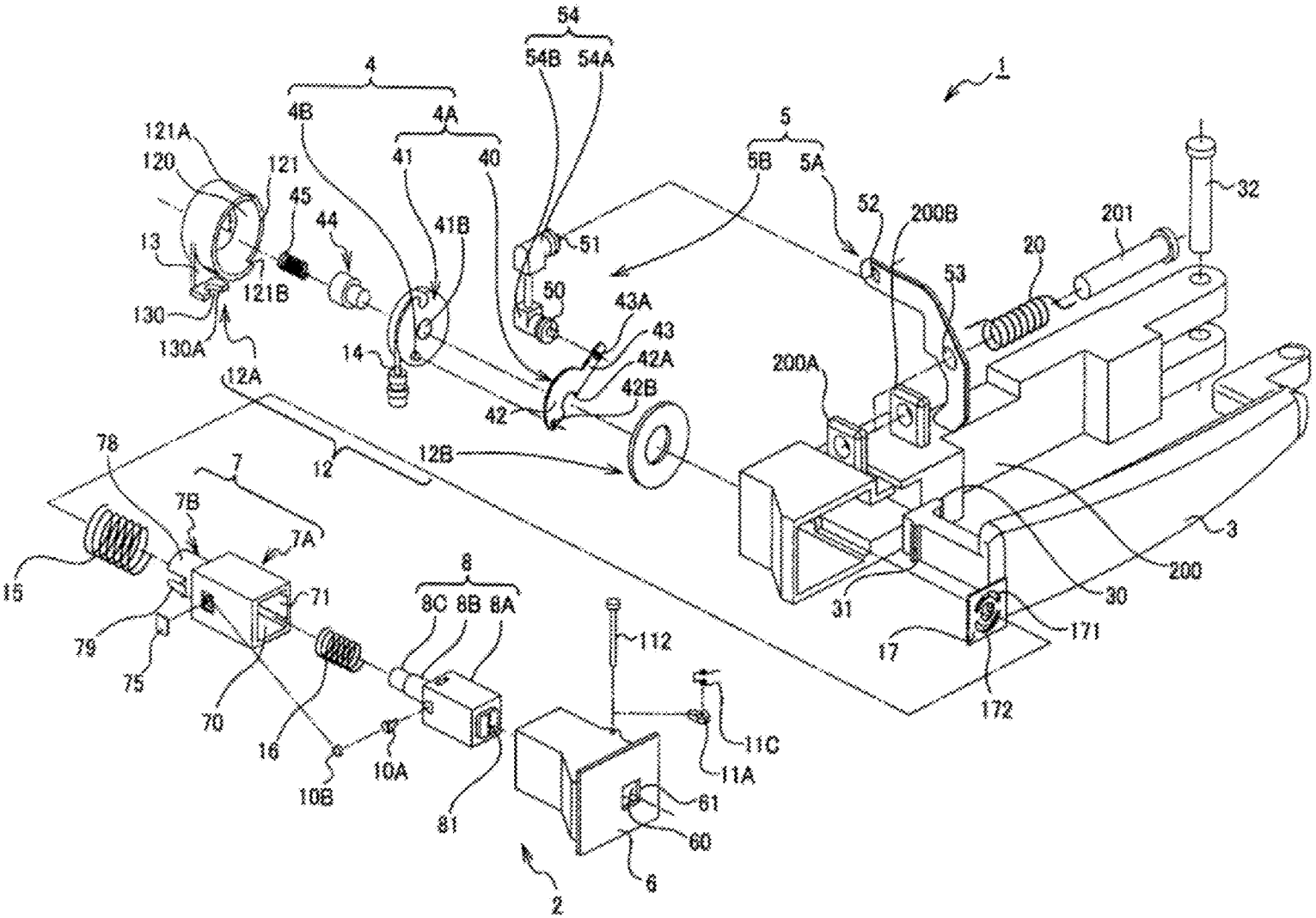
FIG. 1 is an exploded perspective view shown for explaining the entirety of an unlocking device in a preferred embodiment according to the present invention.
Figure 2:
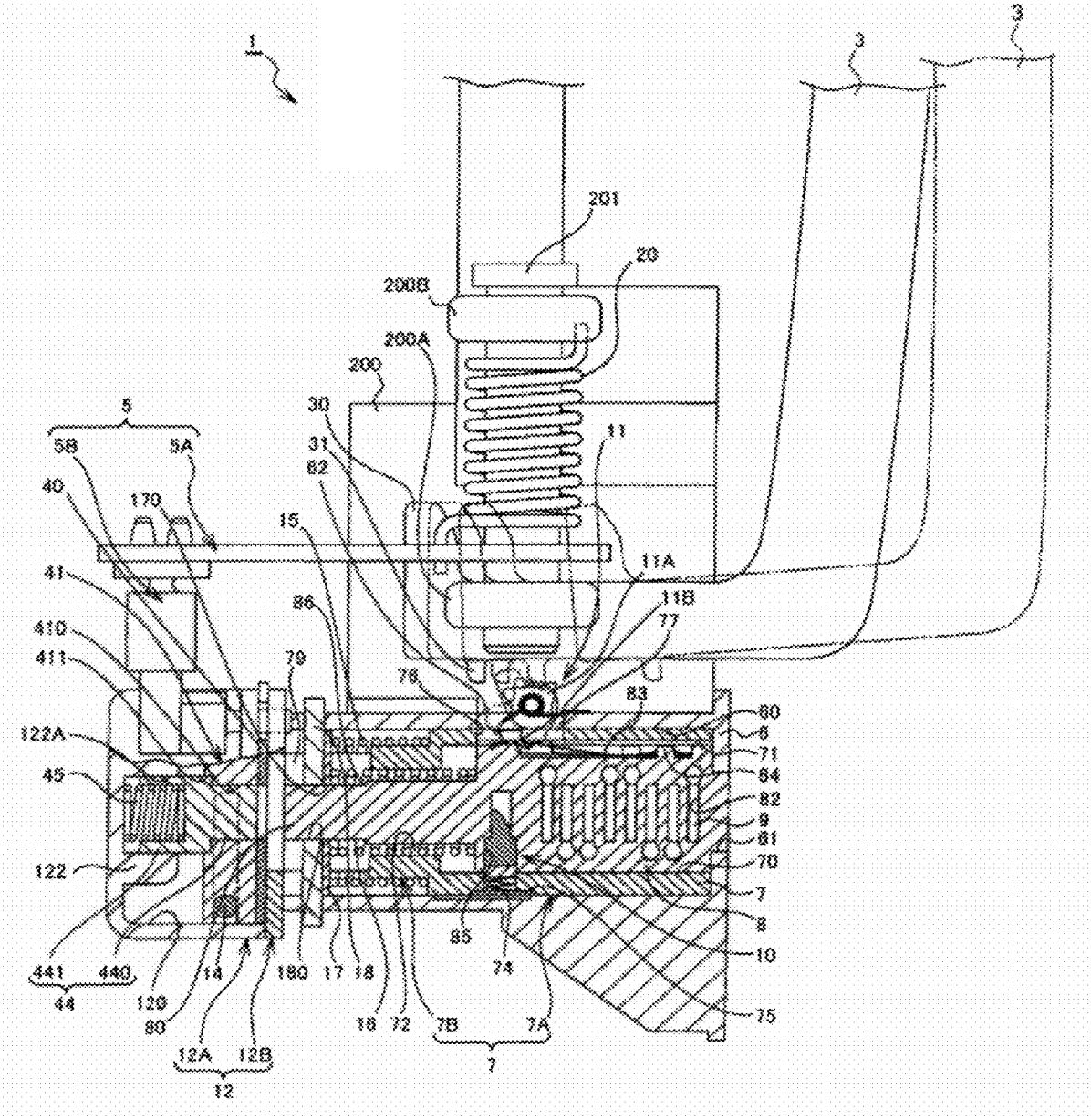
FIG. 2 is a cross sectional view shown for explaining the entirety of the unlocking device in the preferred embodiment according to the present invention.
Figure 3:
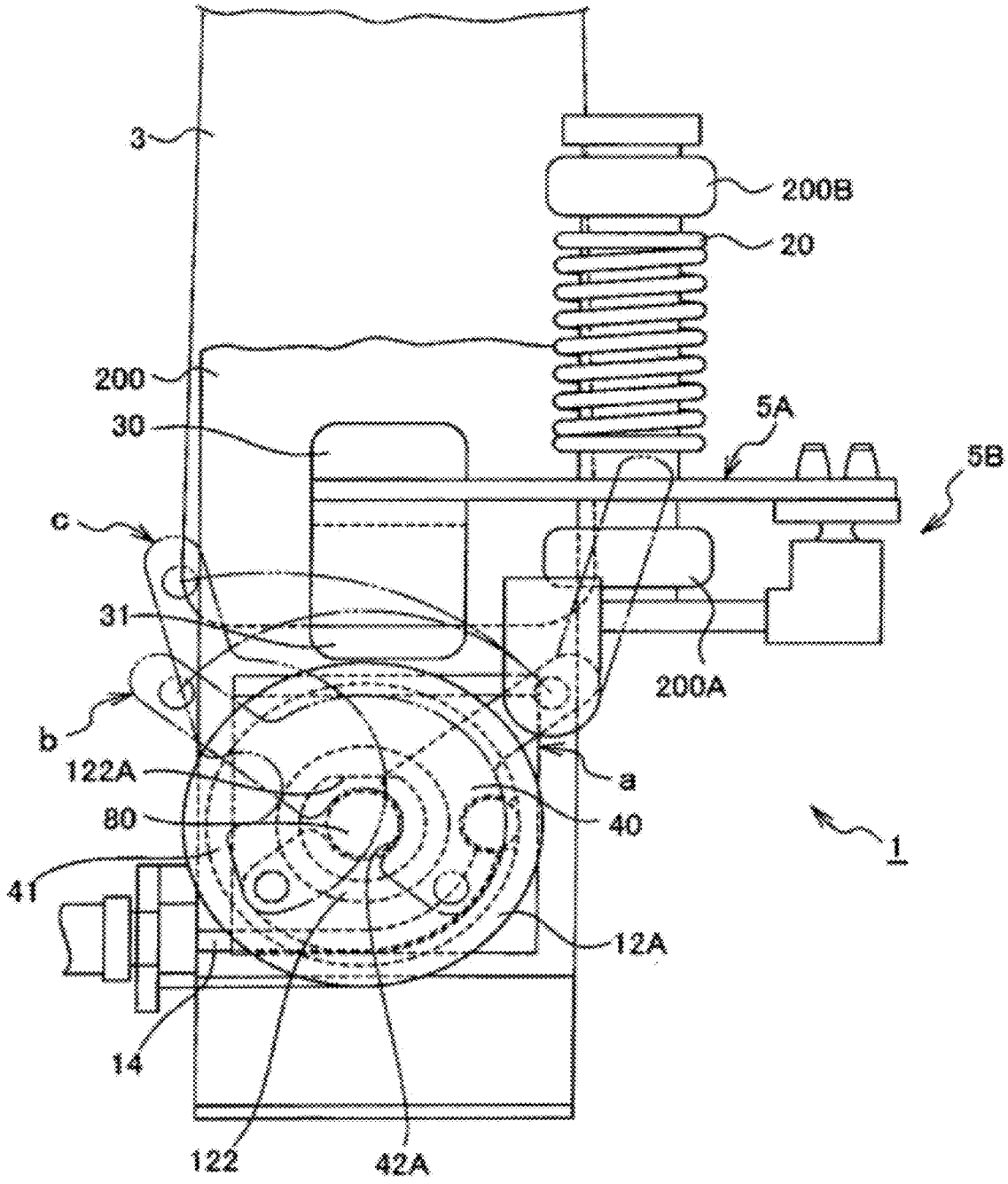
FIG. 3 is a rear view shown for explaining the entirety of the unlocking device in the preferred embodiment according to the present invention.
Figure 4:
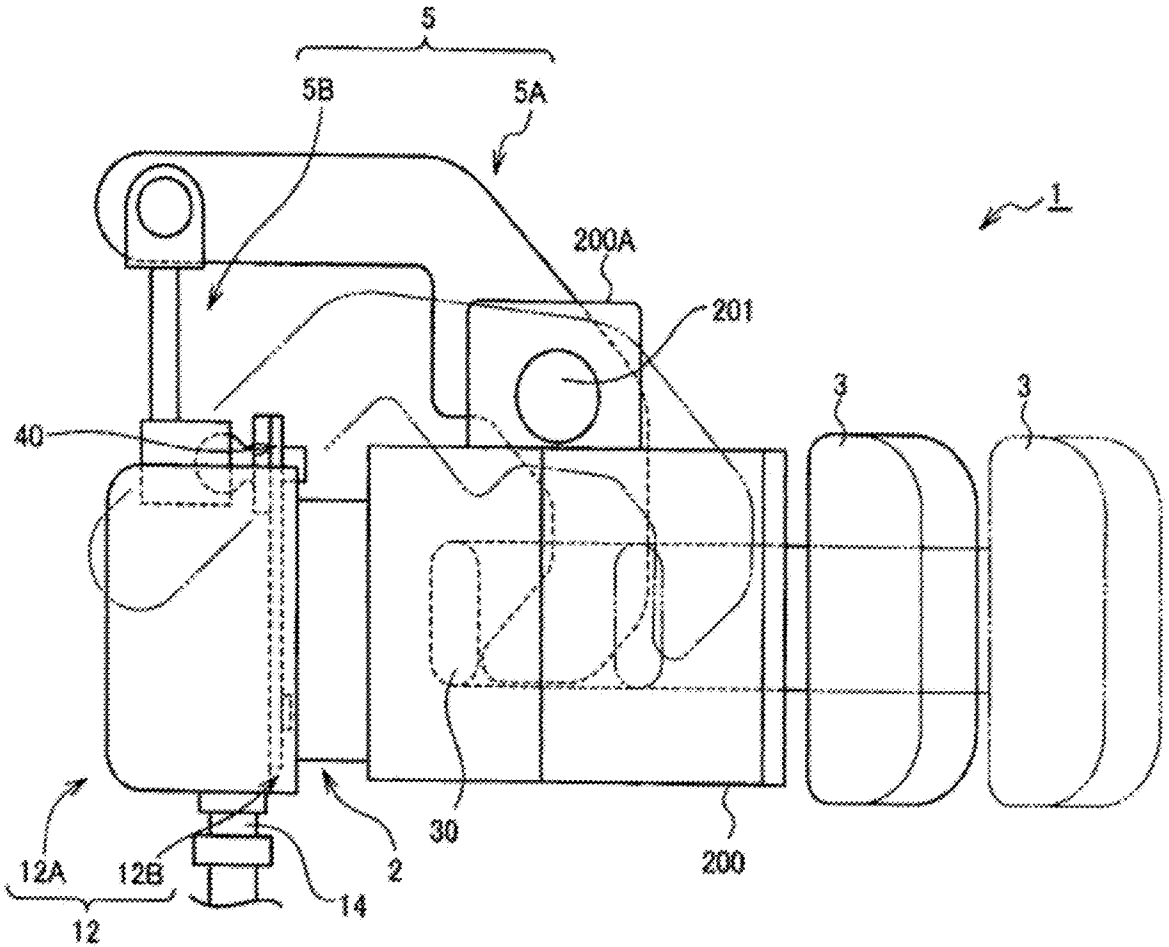
FIG. 4 is a side view shown for explaining the entirety of the unlocking device in the preferred embodiment according to the present invention.
Figure 5:
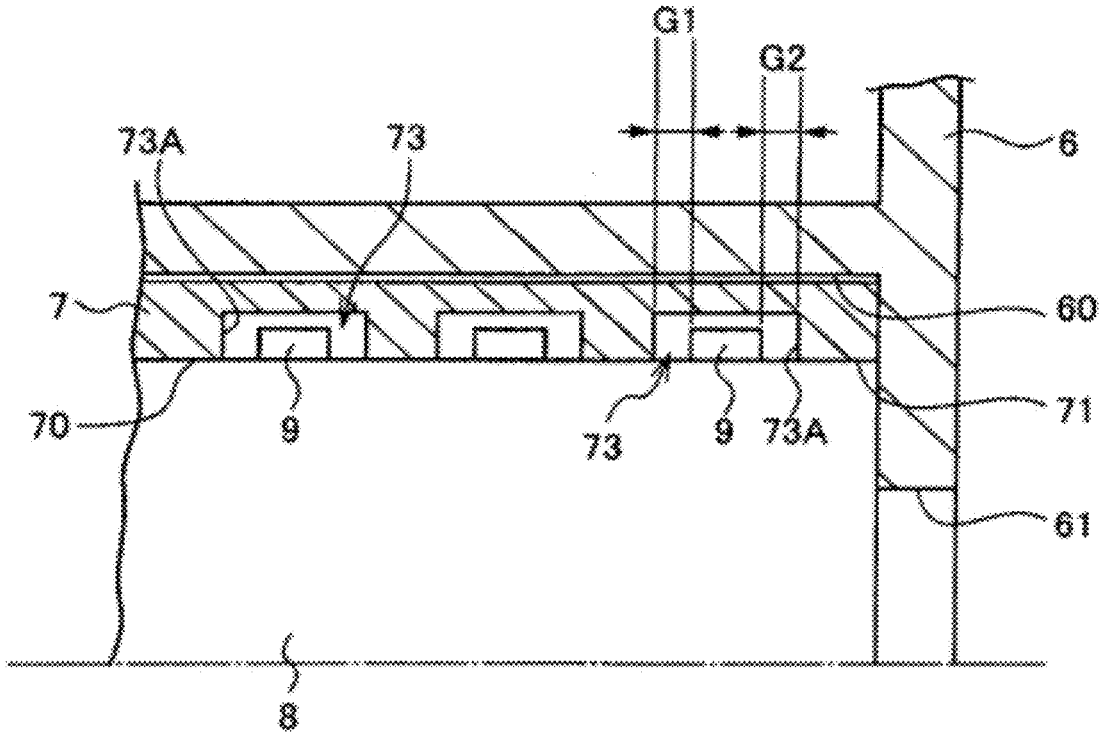
FIG. 5 is simplified cross sectional view shown for explaining a main section of the unlocking device (a cylinder lock) in the preferred embodiment according to the present invention.

FIG. 1 is an exploded perspective view shown for explaining the entirety of an unlocking device in a preferred embodiment according to the present invention. FIG. 2 is a cross sectional view shown for explaining the entirety of the unlocking device in the preferred embodiment according to the present invention. FIG. 3 is a rear view shown for explaining the entirety of the unlocking device in the preferred embodiment according to the present invention. FIG. 4A is a side view shown for explaining the entirety of the unlocking device in the preferred embodiment according to the present invention. FIG. 5 is simplified cross sectional view shown for explaining a main section of the unlocking device (a cylinder lock) in the preferred embodiment according to the present invention. FIG. 6A and FIG. 6B are cross sectional views shown for explaining a first key plug locking mechanism of the unlocking device (a cylinder lock) in the preferred embodiment according to the present invention, where FIG. 6A shows a standby (initial) state and FIG. 6B shows a key insertion state, respectively. FIG. 7 is a cross sectional view shown for explaining a second key plug locking mechanism of the unlocking device (a cylinder lock) in the preferred embodiment according to the present invention.

(Overall Structure of the Unlocking Device)

In FIG. 1, an unlocking device indicated by a reference number 1 substantially comprises a cylinder lock 2 activated by an insertion of a matching key, an operating handle 3 producing an unlocking movement to unlock a door locking mechanism (not shown), a clutch device 4 for transmitting the unlocking movement to the door locking mechanism (a door latch mechanism) by an operation of the cylinder lock 2 and a handle operation force transmission mechanism 5 for transmitting an operating force (a pivoting force) of the operating handle 3 to the clutch device 4.

(Structure of the Cylinder Lock 2)

As shown in FIG. 1 to FIG. 4, the cylinder lock 2 comprises a body 6 as an armoring member, a sleeve 7 housed in this body 6, a key plug 8 having an output portion 80 to output an interrupted motion of the clutch device 4 by moving in this sleeve 7 in an insertion and extraction direction by an insertion and extraction of a matching key, tumblers (locking plates) 9, 9, - - - as a key matching member movably supported to this key plug 8, a first key plug locking mechanism 10 for locking the key plug 8 into the sleeve 7 in the state that the tumblers 9, 9, - - - are inserted (locked) into tumbler locking holes in the sleeve 7 and a second key plug locking mechanism 11 for locking the key plug 8 into the sleeve 7 in the output state of the output portion 80 by an insertion of a matching key into the key plug 8, and is provided on a vehicle frame (a door panel) 200.

On the frame 200, rising portions 200A and 200B are provided in parallel with a predetermined interval in an insertion and extraction direction of the matching key and an orthogonal direction within a pivot plane of the operating handle 3. A pin 201 for a lever pivoting spindle pivotally supporting a transmitting lever 5A of the handle operation force transmission mechanism 5 is fixed between the rising portions 200A and 200B.

As shown in FIG. 1, the body 6 comprises a rectangular box having a housing space 60 for housing the sleeve 7 and a key insert hole (a key plug insertion slot) 61 opening on a key insert (pull-out) side edge face, and is fixed in the frame 200. As shown in FIG. 2, a penetrating window 62 opening on one side of the body piece is provided in the body 6. A case 12 housing the clutch device 4 inside is arranged on the back side of the body 6.

As shown in FIG. 1 and FIG. 2, the case 12 is formed by a case main body 12A in a substantially cup cylindrical shape having the housing space 120 opening on the key insert side and a wire insertion hole (not shown) being communicated with this housing space 120, and a lid 12B in an annular shape blocking the opening on the key insert side of this case main body 12A.

Stopper surfaces 121A and 121B to restrict the pivot movement of an input clutch element (described later) in the clutch device 4 at a position in a circumferential direction 2 of the case 12 are provided on the case main body 12A by forming a notch 121 for lever pivot on a part of the opening. A rising wall 122 having a housing space 122A having a substantially D-shape cross section being communicated with the housing space 120 and a mounting piece 13 having a substantially L-shape cross section are provided integrally at the bottom of the case main body 12A and on the periphery thereof, respectively.

A wire wobble restricting surface 130A to restrict wobbling of a wire 14 connected to the door locking mechanism (not shown) is provided on the mounting piece 13 by forming a notch 130 for hoisting a wire.

As shown in FIG. 1 and FIG. 2, the sleeve 7 comprises a sleeve main body 7A in a rectangular box shape having an opening 71 being communicated with a first housing space 70 which can accommodate a first barrel and a second barrel (described later) of the key plug 8 and the key insert hole 61, and a sleeve barrel 7B in a substantially cylindrical shape having a second housing space 72 being communicated with the first housing space 70 of this sleeve main body 7A. The sleeve 7 is arranged to be movable between the key insert side and the key anti-insertion side of the housing space 60 in the body 6, and is configured to move and return to the key insert side by a spring (a compression spring) 15 for the return of the sleeve.

The tumbler locking holes 73, 73, - - - (shown in FIG. 5) opening inside the sleeve 7 are provided on the sleeve main body 7A. A first through-hole 74 penetrating one side of the sleeve 7 is provided on the key anti-insertion side end of the sleeve main body 7A. A body side opening of the first through-hole 74 is blocked by a cover 75. Furthermore, a second through-hole 76 penetrating another side of the sleeve 7 and being communicated with the penetrating window 62 of the body 6 is provided on the key anti-insertion side end of the sleeve main body 7A. A spring receiving portion 77 having a first receiving surface 77A and a second receiving surface 77B (both are shown in FIG. 7) is provided in a protruding condition on the inner surface of the second through-hole 76. The first receiving surface 77A and the second receiving surface 77B of the spring receiving portion 77 are configured to receive a resilient force of a locking piece of the second key plug locking mechanism 11 in the state that the tumblers 9, 9, - - - are inserted into the tumbler locking holes 73, 73, - - - and the state that the tumblers 9, 9, - - - are withdrawn from the tumbler locking holes 73, 73, - - - (the key plug 8 is locked into the sleeve 7 by the second key plug locking mechanism 11), respectively.

The sleeve barrel 7B comprises barrel elements 78 and 79 arranged in parallel having equal intervals in a circumferential direction of the sleeve 7 and is provided integrally on an edge face opposite to the key insert side edge face of the sleeve main body 7A (a rim of the key ant-insertion side opening of the first housing space 70).

As shown in FIG. 1 and FIG. 2, the key plug 8 has a first barrel 8A, a second barrel 8B and a third barrel 8C, and is arranged to be movable between the key insert side and the key anti-insertion side in the sleeve 7 (the first housing space 70 and the second housing space 72). And it is configured to move and return to the key insert side by a spring (a compression spring) 16 for the return of the key plug.

The first barrel 8A has a key insert hole 81 opening on the key insert side edge face allowing the matching key to be inserted and removed, and is formed by a rectangular shape box in a substantially square shape cross section entirely. Tumbler holding holes 82, 82, - - - arranged in parallel in a key insertion and extraction direction and opening in a direction orthogonal to the key insertion direction are provided in the first barrel 8A. A concave groove 83 being communicated with the second through-hole 76 opening on one side and a spring mounting portion 84 protruding from the groove bottom on this key insert side of the concave groove 83 are provided on the key anti-insertion side end of the first barrel 8A. A locking piece 11B of the second key plug locking mechanism 11 is housed in the concave groove 83 of the first barrel 8A in the state of being installed to the spring mounting portion 84. Furthermore, a concave hole 85 in a step-like shape, which is communicated with the first through-hole 74 of the sleeve main body 7A, is provided on the key anti-insertion side end of the first barrel 8A in the state of being communicated with the key insert hole 81 (inside the key plug 8) opening on another side thereof and the state that the tumblers 9, 9, - - - are inserted into the tumbler locking holes 73, 73, - - - .

The second barrel 8B is connected to the first barrel 8A and the third barrel 8C continuously, is arranged on an axis line of the key insert hole 81 and formed by a cylinder having an outer diameter smaller than the horizontal and vertical section size (one side of the square) of the first barrel 8A entirely.

The third barrel 8C has an output portion 80 (described previously) on the key anti-insertion side and is arranged on an axis line of the second barrel 8B. And the output portion 80 is configured to function as a pivoting spindle to pivotally support an input clutch element 40 and an output clutch element 41 of the clutch device 4 in the output state by an insertion of the matching key into the key insert hole 81. The outer diameter of the third barrel 8C is set to be a dimension smaller than that of the second barrel 8B. A key plug step-like surface 86 directing to the key anti-insertion side (a clutch device side) and facing to a rim of the key insert side opening of a key plug insert hole (described later) of a spring stopper 17 is provided along a circumferential direction between the periphery surface of the third barrel 8C and that of the second barrel 8B.

The spring stopper 17 has a key plug insert hole 170 letting through the third barrel 8C and element insert holes 171 and 172 letting through barrel elements 78 and 79 of the sleeve barrel 7B around this key plug insert hole 170. The spring stopper 17 is arranged on an axis line of the sleeve 7, is housed in the state intermediating between a positioning plate 18 and springs 15 and 16 in the body 6 and is configured to function as a key plug movement restricting member which restricts a movement of the key plug 8 in a key insert direction by contacting the key plug step-like surface 86 (the key plug 8) with a rim of the key insert side opening of the key plug insert hole 170 and to restrict the movement of the key plug 8 at a position preceding the position where the movement of the sleeve 7 in a key insert direction is restricted. Consequently, a dimension of a key insertion and extraction direction between the spring stopper 17 and the key plug step-like surface 86 is set to be smaller than that between the key anti-insertion side edge face of the sleeve 7 and the spring stopper 17 in the state that the key plug 8 is locked by the first key plug locking mechanism 10. As a result, when the key plug 8 moves in a key insert direction with the sleeve 7 by the insertion of the unauthorized key into the key insert hole 81, the movement of the key plug 8 in a key insert direction is restricted by contacting the key plug step-like surface 86 with the key insert side edge face of the spring stopper 17 (a rim of the key insert side opening of the key plug insert hole 170) prior to the sleeve 7 and it is possible to avoid a load by a contact of the tumblers 9, 9, - - - which is received by the inner surface of the tumbler locking holes 73, 73, - - - .

Similar to the spring stopper 17, the positioning plate 18 has a key plug insert hole 180 letting through the third barrel 8C of the key plug 8 and element insert holes (not shown) letting through the barrel elements 78 and 79 of the sleeve barrel 7B around this key plug insert hole 180, is arranged on an axis line of the sleeve 7 and fixed on the body 6.

As shown in FIG. 5, the each of tumblers 9, 9, - - - is arranged to be insertable and removable in the tumbler locking holes 73, 73, - - - and is movable supported by the tumbler holding holes 82, 82, - - - . Furthermore, the tumblers 9, 9, - - - are arranged with gaps G1 and G2 between an inner surface 73A of the tumbler locking hole 73 and a key insertion and extraction direction in the state that the key plug 8 is locked into the sleeve 7 by a lock pin (described later) of the first key plug locking mechanism 10. And the tumblers 9, 9, - - - are configured to be withdrawn from the tumbler locking holes 73, 73, - - - by an insert operation of the matching key to the key plug 8 (the key insert hole 81) and to be inserted into the tumbler locking holes 73, 73, - - - by a pull-out operation of the matching key from the key plug 8. Furthermore, a resilient force of a tumbler return spring (not shown) in a direction inserted into the tumbler locking holes 73, 73, - - - is imparted to the tumblers 9, 9, - - - .

Figure 6:
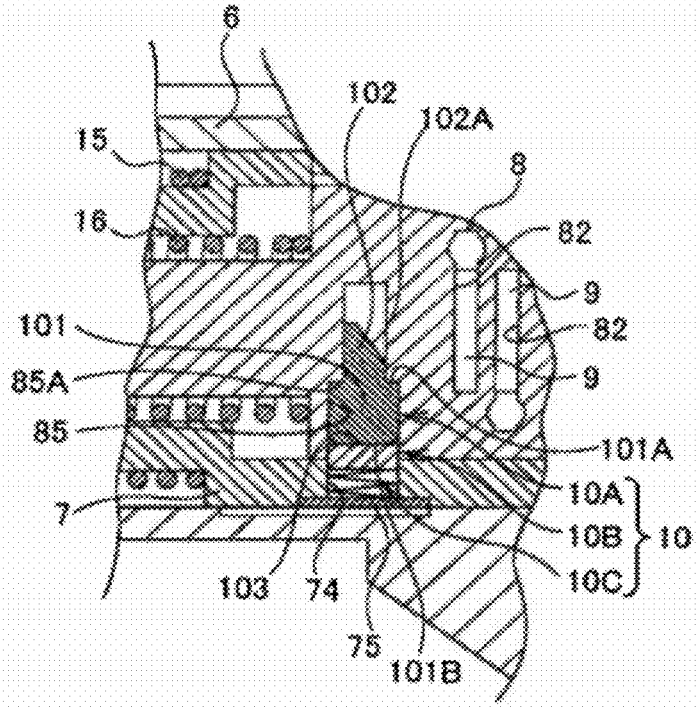
FIG. 6A and FIG. 6B are cross sectional views shown for explaining a first key plug locking mechanism of the unlocking device (a cylinder lock) in the preferred embodiment according to the present invention.
Figure 6:
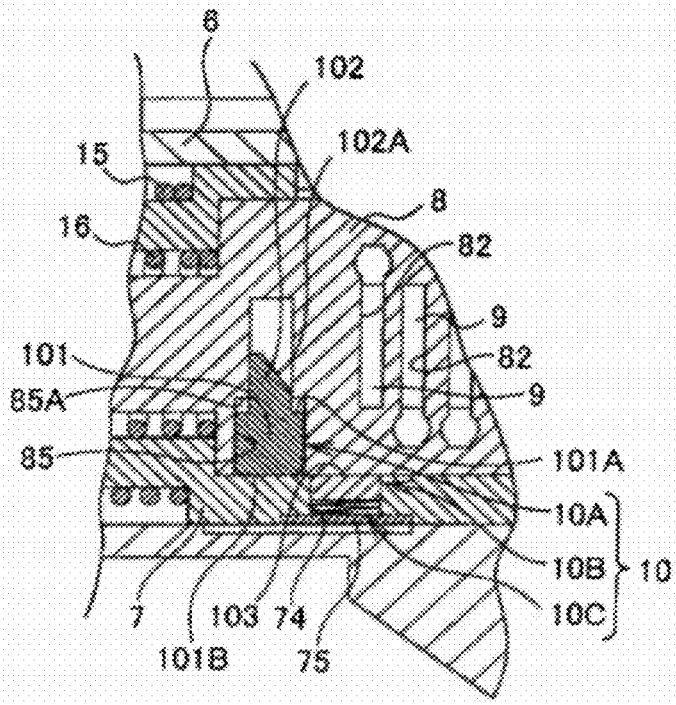
Figure 7:
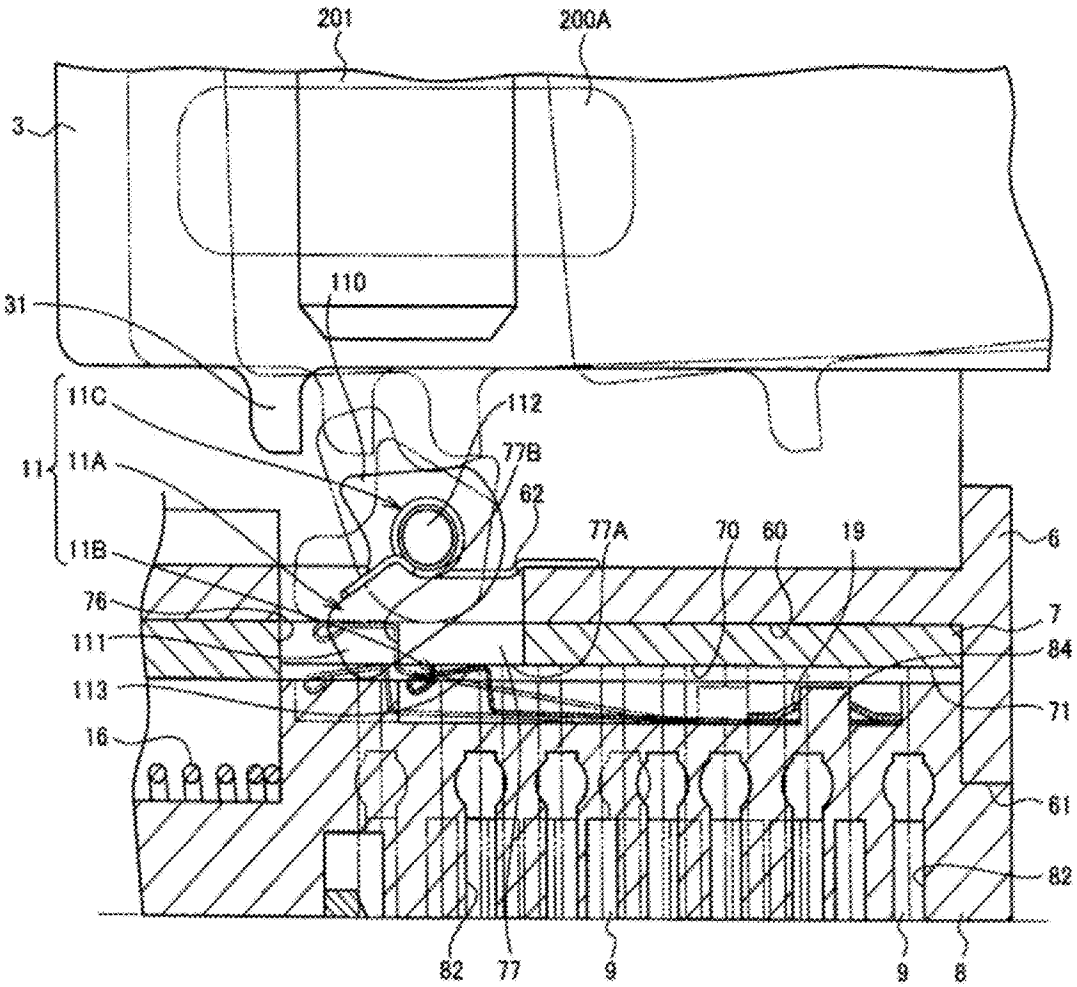
FIG. 7 is a cross sectional view shown for explaining a second key plug locking mechanism of the unlocking device (a cylinder lock) in the preferred embodiment according to the present invention.

As shown in FIG. 2 and FIG. 6, the first key plug locking mechanism 10 has a cam pin 10A moving in the key plug 8 by an insertion and extraction of the matching key to the key insert hole 81, a lock pin 10B locking and releasing the key plug 8 by a movement of this cam pin 10A and a spring 10C for pressing a pin to impart a resilient force of a direction to lock the key plug 8 into the sleeve 7 to this lock pin 10B (a lock pin 10B and a cam pin 10A in the locking state of the key plug 8 by the first key plug locking mechanism 10), and is arranged between the sleeve 7 and the key plug 8. And, as mentioned-above, it is configured to lock the key plug 8 into the sleeve 7 in the state that the tumblers 9, 9, - - - are inserted into the tumbler locking holes 73, 73, - - - .

The cam pin 10A comprises a basal portion 101 in a substantially rectangular shape having an edge face 101A facing to a step-like surface 85A of the concave hole 85 and a cam portion 102 having a cam face 102A continuously connected to this basal portion 101, and is movably housed in the concave hole 85 and the key insert hole 81. And it is configured to press the lock pin 10B withdrawing in a direction to separate from the axis line of the key insert hole 81 by an insert operation of the matching key into the key insert hole 81 and also to proceed in a direction to approach the axis line of the key insert hole 81 by a pull-out operation of the matching key from the key insert hole 81.

The lock pin 10B comprises a substantially cylindrical body having a pressing surface 103 facing to an edge face 101B of the cam pin 10A (basal portion 101) and is arranged to be movable between the key plug 8 and the sleeve 7. And it is configured to be embedded in the first through-hole 74 of the sleeve 7 in the state that the tumblers 9, 9, - - - are withdrawn from the tumbler locking hole 73, 73, - - - and to press the pressing surface 103 against the edge face 101B of the cam pin 10A by exposing a portion thereof in the concave hole 85 of the key plug 8 in the state that the tumblers 9, 9, - - - are inserted into the tumbler locking hole 73, 73, - - - .

The spring 10C for pressing a pin is arranged in the first through-hole 74 of the sleeve 7 and resiliently mounted between the lock pin 10B and the cover 75. And it is configured that the lock pin 10B is pressed and connected to the periphery surface of the key plug 8 in the state that the key plug 8 is moved in a key insert direction by releasing the locking state of the key plug 8 into the sleeve 7 (the state that the tumblers 9, 9, - - - are inserted into the tumbler locking hole 73, 73, - - - ), and the cam pin 10A is pressed and connected to the step-like surface 85A of the concave hole 85 via the lock pin 10B in the state that the key plug 8 is locked into the sleeve 7 by the first key plug locking mechanism 10 (the state that the tumblers 9, 9, - - - are inserted into the tumbler locking hole 73, 73, - - - ), respectively.

As shown in FIG. 2 and FIG. 7, the second key plug locking mechanism 11 has a lever 11A for pressing a locking piece which pivots by a handle operation (pivotal operation) force of the operating handle 3 and an elastic return force of a spring 11C (described later) by the proceeding of the key plug 8, the locking piece 11B locking the key plug 8 into the sleeve 7 by an elastic deformation by pressure of the this lever 11A and the spring 11C for transmitting a locking force to impart a resilient force in a direction to maintain a locking state of the key plug 8 by this locking piece 11B to the lever 11A, and is arranged between the operating handle 3 and the key plug 8. And, as mentioned-above, it is configured to lock the key plug 8 into the sleeve 7 in the output state of the output portion 80 by an insertion of the matching key into the key plug 8 (the key insert hole 81). Furthermore, the second key plug locking mechanism 11 is configured to release the locking state of the key plug 8 to the sleeve 7 when receiving the handle operation force of the operating handle 3 in a direction that the lever 11A opens a door panel in the output state of the output portion 80.

The lever 11A for pressing a locking piece comprises an operation force receiving portion 110 for receiving a handle operation force of the operating handle 3 and a press portion 111 elastically deforming the locking piece 11B (a spring deformed portion 113) by pressing, is supported to the body 6 via a pin 112 and arranged to be movable on one side of the spring receiving portion 77 in the penetrating window 62 of the body 6, the second through-hole 76 and the first housing space 70 of the sleeve 7 by exposing a portion thereof to outside of the body.

The locking piece 11B comprises a plate spring having the spring deformed portion 113 which becomes a locking portion by an elastic deformation by pressure of the lever 11A on an end of one side, and is housed in the concave groove 83 of the key plug 8 in the state that an end of another side is installed to a spring mounting portion 84 by a spring holding member 19. And it is configured that the spring deformed portion 113 presses and connects the second receiving surface 77B of the spring receiving portion 77 by elastically deforming into the locking portion in the output state (the state indicated by two-dot chain lines in FIG. 7) of the key plug 8 (the output portion 80) by an insertion of the matching key into the key insert hole 81, and to lock the key plug 8 into the sleeve 7. Furthermore, it is configured that the spring deformed portion 113 presses and connects to the first receiving surface 77A of the spring receiving portion 77 as an unlocking portion in the state that the tumblers 9, 9, - - - are inserted into the tumbler locking hole 73, 73, - - - (the state indicated by continuous lines in FIG. 7) and the locking state of the key plug 8 to the sleeve 7 is released.

The spring 11C for transmitting a locking force is arranged around the pin 112 in which both spring ends are locked into the body 6 and the lever 11A respectively, and the entirety is formed by a double torsion spring.

(Structure of the Operating Handle 3)

As shown in FIG. 1 to FIG. 4, the operating handle 3 has a first press portion 30 to impart a pivotal operation force (a handle operation force) of a direction to release a door locking mechanism (a direction to open a door panel) to the transmitting lever 5A of the handle operation force transmission mechanism 5 and a second press portion 31 to impart a handle operation force thereof to the lever 11A of the second key plug locking mechanism 11, is movably supported to the frame 200 and return characteristics are imparted by a spring (a torsion spring) 20 for returning the transmission lever. And it is configured to pivot with a pin 32 as a turning center within a predetermined pivot range and to generate an unlocking movement (an opening movement to open the door panel) to unlock the door locking mechanism. As a result, when the operating handle 3 is operated pivotally in a door panel opening direction in the output state of the key plug 8 (the output portion 80) by an insertion of the matching key into the key insert hole 81, this operation force is transmitted to the clutch device 4 (an input clutch element 4A and an output clutch element 4B) via the handle operation force transmission mechanism 5, further transmitted to the door locking mechanism (door latch mechanism) from this clutch device 4 via a wire 14, and this door locking mechanism is unlocked. Furthermore, when the operation state of the operating handle 3 is released, the operating handle 3 returns pivotally by the spring 20 for returning the transmission lever via the handle operation force transmission mechanism 5 and is arranged in a return position (the position before operating the operating handle 3).

When the operating handle 3 is operated pivotally in an opening direction of the door panel in the unlocking state of the door locking mechanism, since the door locking mechanism is unlocked, the door panel is opened pivoting in a opening direction around a pivot bearing. Furthermore, when the door panel is blocked in the closing direction by operating pivotally in the open state, the door lock mechanism is locked.

(Structure of the Clutch Device 4)

As shown in FIG. 1 to FIG. 4, the clutch device 4 has a clutch 4A to switch on and off between the operating handle 3 (the handle operation force transmission mechanism 5) and the door locking mechanism (not shown) and a connecting pin 4B movably connecting the input clutch element (an input lever) 40 and the output clutch element (an output lever) 41 of this clutch 4A, and is housed in the housing space 120 of the case 12. And it is configured to receive an unlocking movement of the operating handle 3 from the handle operation force transmission mechanism 5 and to transmit it to the door locking mechanism in the output state of the cylinder lock 2.

The clutch 4A has a an input clutch element 40 actuated by receiving a handle operation force of the operating handle 3 from the handle operation force transmission mechanism 5 and an output clutch element 41 to output an actuating force received from the input clutch element 40 as an unlocking movement of the operating handle 3 in the output state of the cylinder lock 2 by an insertion operation of the matching key, and is arranged on the axis line of the key plug 8.

The input clutch element 40 comprises a main frame 42 in a flat D-shape having a notch 42A letting through the third barrel 8C of the key plug 8 and a through-hole 42B for connecting a clutch engaging with the connecting pin 4B and an arm portion 43 having a through-hole 43A for connecting a link engaging with a transmitting link 5B (a pin 50) of the handle operation force transmission mechanism 5, is movably connected to the transmitting link 5B via the pin 50 and arranged on the axis line of the key plug 8. And it is configured to transmit the pivoting force (a handle operation force) to the door locking mechanism by pivoting with the output clutch element 41 from a position "a" indicated by broken lines in FIG. 3 to a position "b" indicated by two-dot chain lines in FIG. 3 (a position displaced at 105° from the position "a" turning around the key plug 8) when receiving an unlocking movement of the operating handle 3 in the output state of the cylinder lock 2 by an insertion of the matching key (the state that the input clutch element 40 and the output clutch element 41 are movably supported on the output portion 80 of the key plug 8 and the handle operation force transmission mechanism 5 is connected to the door locking mechanism). Furthermore, it is configured not to transmit an oscillating force (a handle operation force) to the door locking mechanism by oscillating from the position "a" indicated by broken lines in FIG. 3 to a position "c" indicated by two-dot chain lines in FIG. 3 when receiving the operation force of the operating handle 3 in the non-output state of the cylinder lock 2 (the state that the input clutch element 40 and the output clutch element 41 are not supported on the output portion 80 of the key plug 8 and the connection between the handle operation force transmission mechanism 5 and the door locking mechanism is blocked).

The output clutch element 41 comprises a circular disc having a through-hole 41B for a stopper key plug insertion opening in a moving direction of the key plug 8 and is movably connected to the input clutch element 40 via the connecting pin 4B and to the door locking mechanism (latch mechanism) via the wire 14, respectively. And it is configured to output the actuating force (pivoting force) received from the input clutch element 40 as an unlocking movement of the operating handle 3 to the wire 14 in the output state of the cylinder lock 2 by an insertion of the matching key and to unlock the door locking mechanism by transmitting this output from the wire 14 to the door locking mechanism. Furthermore, the output clutch element 41 is arranged on the axis line of the key plug 8 and movably supported around a clutch stopper 44 (a supporting portion 440). And return characteristics are imparted to the door locking mechanism side via the wire 14.

The through-hole 41B of the output clutch element 41 is formed by a step-like hole comprising a round hole 410 opening on the key insert side allowing the third barrel 8C of the key plug 8 to be inserted and a D-shaped hole 411 opening on the key anti-insertion side being communicated with this round hole 410.

The clutch stopper 44 comprises a supporting portion 440 in a cylindrical shape rotatably supporting the output clutch element 41 inserting into the round hole 410 and a basal portion 441 in a D-shape cross section insertable into the D-shaped hole 411, is supported movably on the housing space 122A of the rising wall 122 (impossible to rotate around the axis line of the output clutch element 41) and arranged on the axis line of the output clutch element 41. And it is configured to movably support the output clutch element 41 with the output portion 80 of the key plug 8 at the supporting portion 440 withdrawing the basal portion 441 from the D-shaped hole 411 to the key anti-insertion side in the output state of the cylinder lock 2 (the output portion 80) by an insertion of the matching key and to fix the output clutch element 41 in a rotation direction at the basal portion 441 proceeding the basal portion 441 into the D-shaped hole 411 in the non-output state of the cylinder lock 2. Furthermore, a resilient force of a spring (a compression spring) 45 for pressing a stopper is imparted to the clutch stopper 44 on the key insert side.

The connecting pin 4B is provided integrally in a protruding condition at the rim of key insert side outer periphery in the output clutch element 41. And it is configured to function as a pin for a clutch element transmission to transmit a handle operation force of the operating handle 3 from the input clutch element 40 to the output clutch element 41 in the output state of the key plug 8 (the output portion 80) by an insertion of the matching key to the key insert hole 81.

(Structure of the Handle Operation Force Transmission Mechanism 5)

As shown in FIG. 1 to FIG. 4, the handle operation force transmission mechanism 5 has a transmitting lever 5A pivoting by receiving a handle operation force (a pivotal operation force) of the operating handle 3 and a transmitting link 5B hoisting by receiving the pivoting force from this transmitting lever 5A, and is supported on the frame 200 intermediating between the operating handle 3 and the clutch device 4. And it is configured to transmit the handle operation force (the pivoting force) of the operating handle 3 to the clutch device 4 as mentioned above.

The transmitting lever 5A comprises a pivot lever in a substantially L-shape having a pin hole 52 for connecting a link fitting in a pin 51 of the transmitting link 5B, is arranged between the rising portions 200A and 200B and movably supported around the pin 201. And the return characteristic is imparted by the spring 20 for return of the transmitting lever. A pin hole 53 letting through the pin 201 is provided on the transmitting lever 5A.

The transmitting link 5B comprises a link body 54 having pin junctions 54A and 54B protruding in a direction to be orthogonal each other in the pivot plane of the operating handle 3 and the pins 50 and 51 (described previously) with a ball joint connecting the pin junctions 54A and 54B of this link body 54 and is arranged between the transmitting lever 5A (the pin hole 52) and the input clutch element 40A (the through-hole 43A). And, similar to the transmitting lever 5A, it is configured that the return characteristics are imparted by the spring 20 for return of the transmitting lever so as to function as a link for three-dimensional actuation.

(Motion of the Unlocking Device 1)

Figure 8:
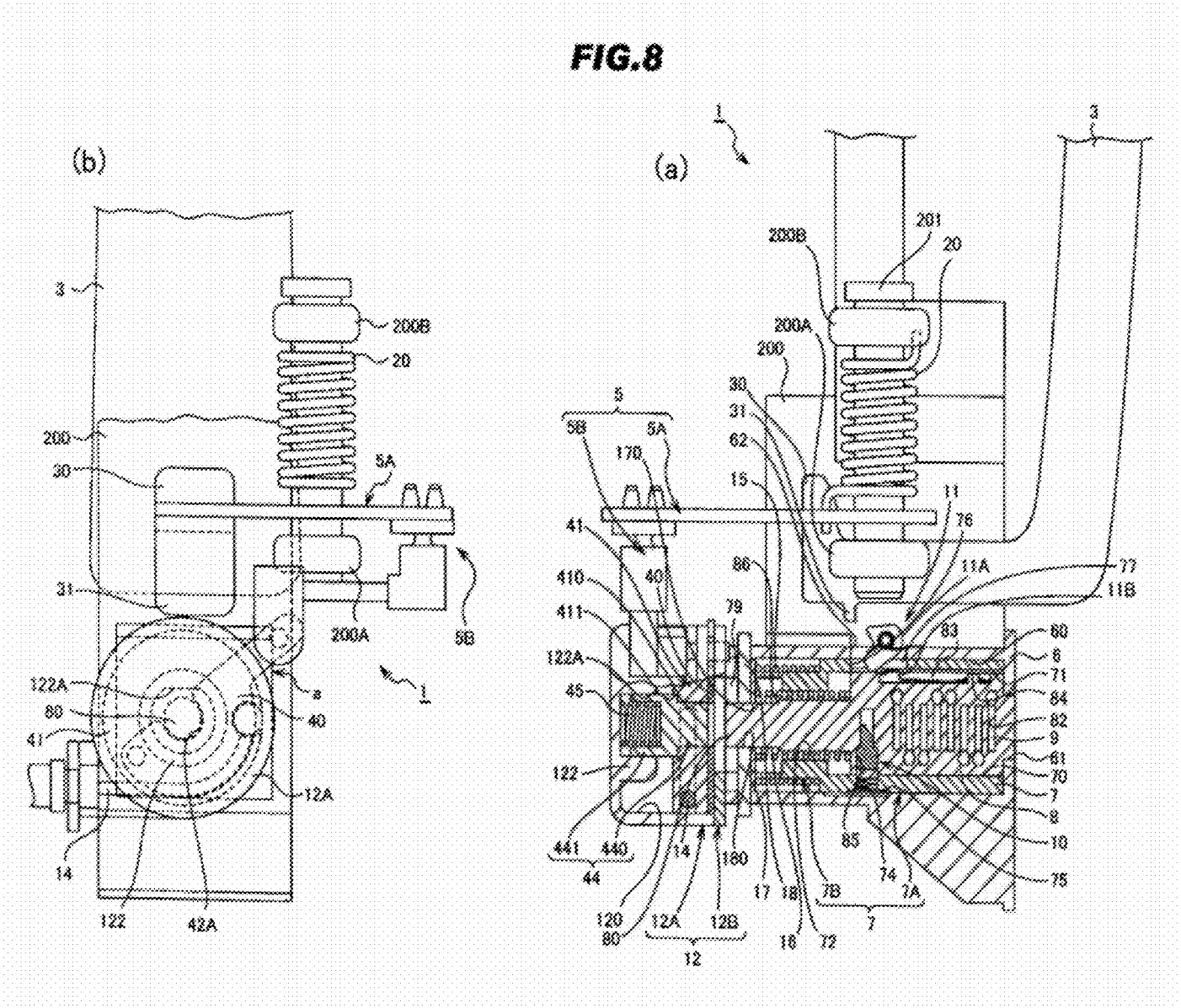
FIG. 8A and FIG. 8B are a cross sectional view and a rear view showing a standby state of the unlocking device in the preferred embodiment according to the present invention.
Figure 9:
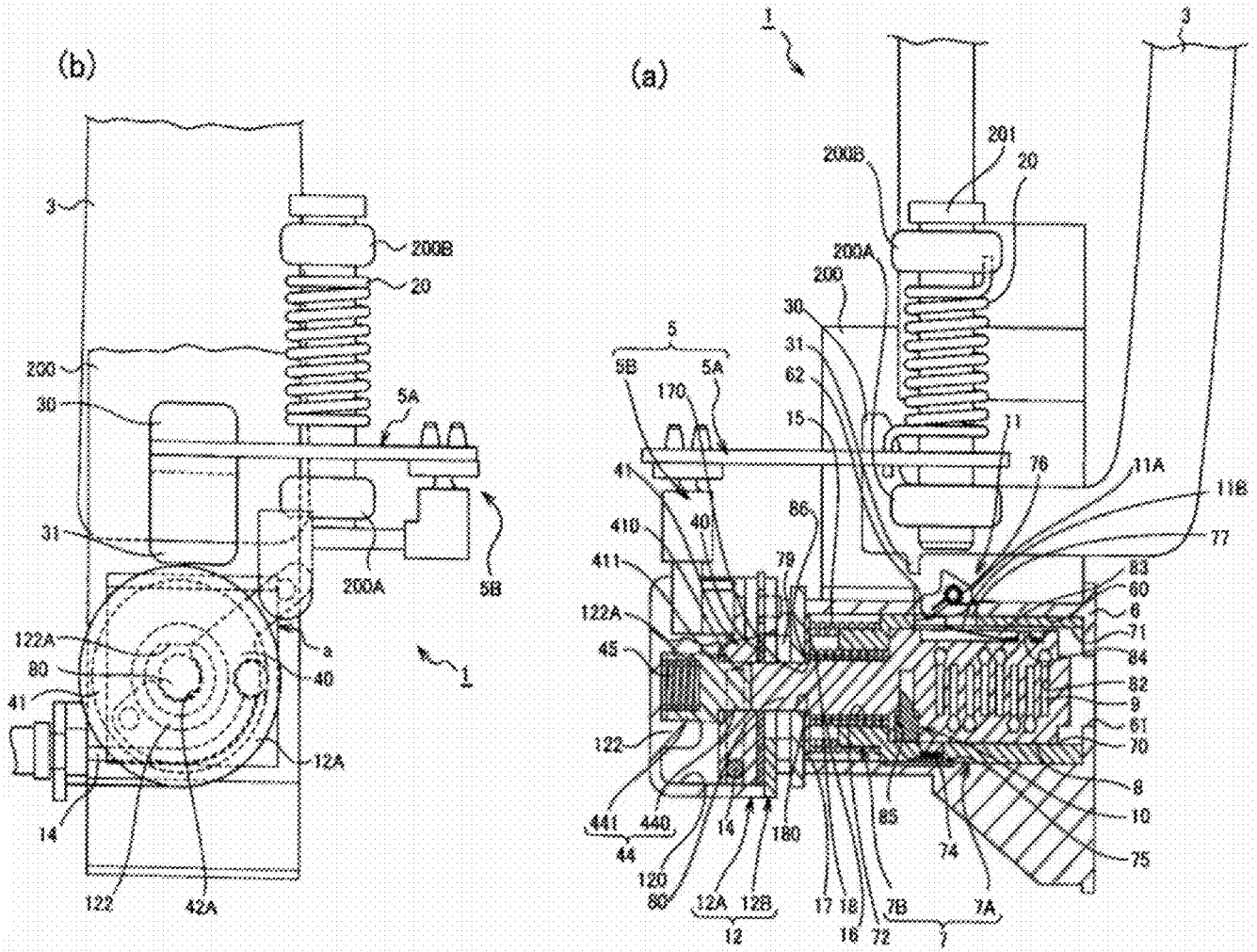
FIG. 9A and FIG. 9B are a cross sectional view and a rear view shown for explaining the operation when a matching key is inserted into a cylinder lock of the unlocking device in the preferred embodiment according to the present invention.
Figure 10:
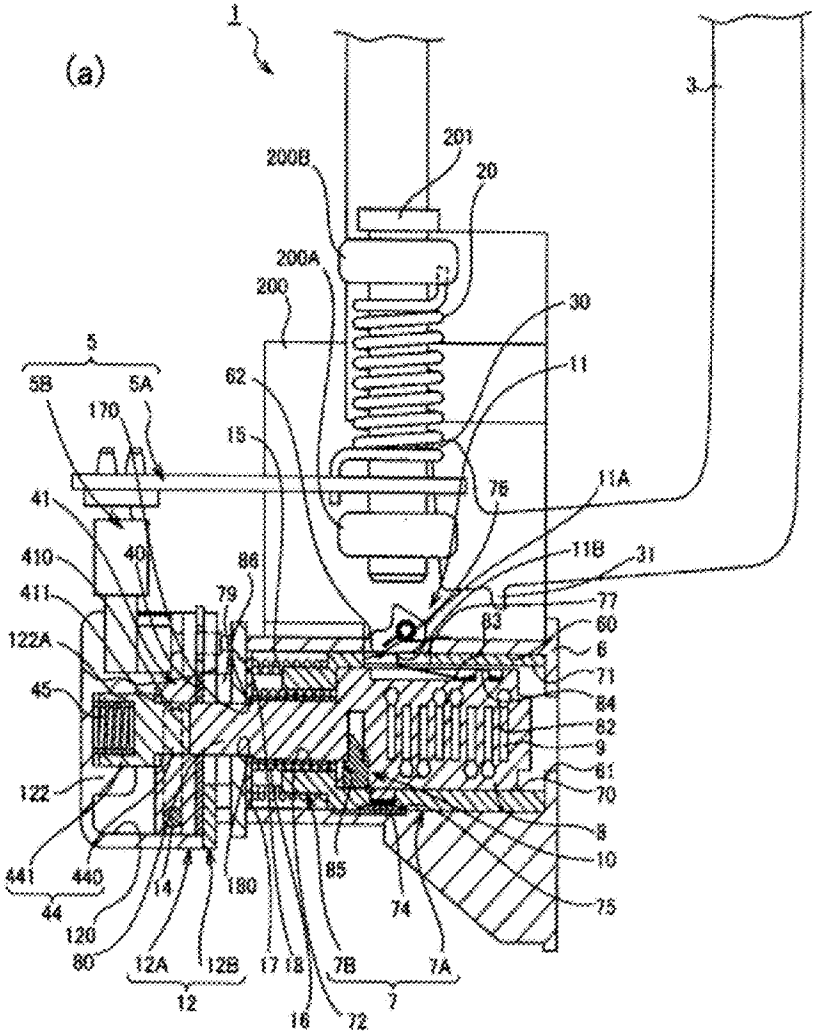
FIG. 10A and FIG. 10B are a cross sectional view and a rear view shown for explaining the operation when the operating handle of the unlocking device is operated in the preferred embodiment according to the present invention.
Figure 10:
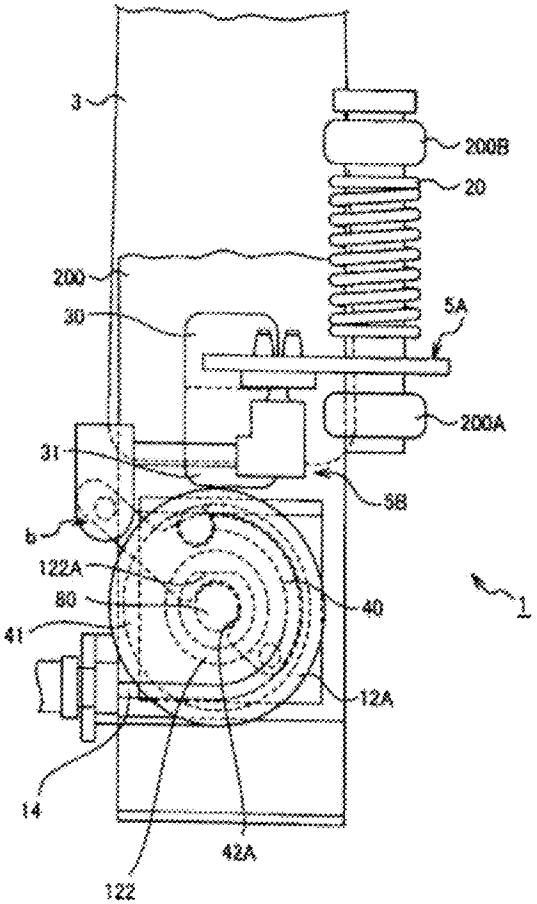
Figure 11:
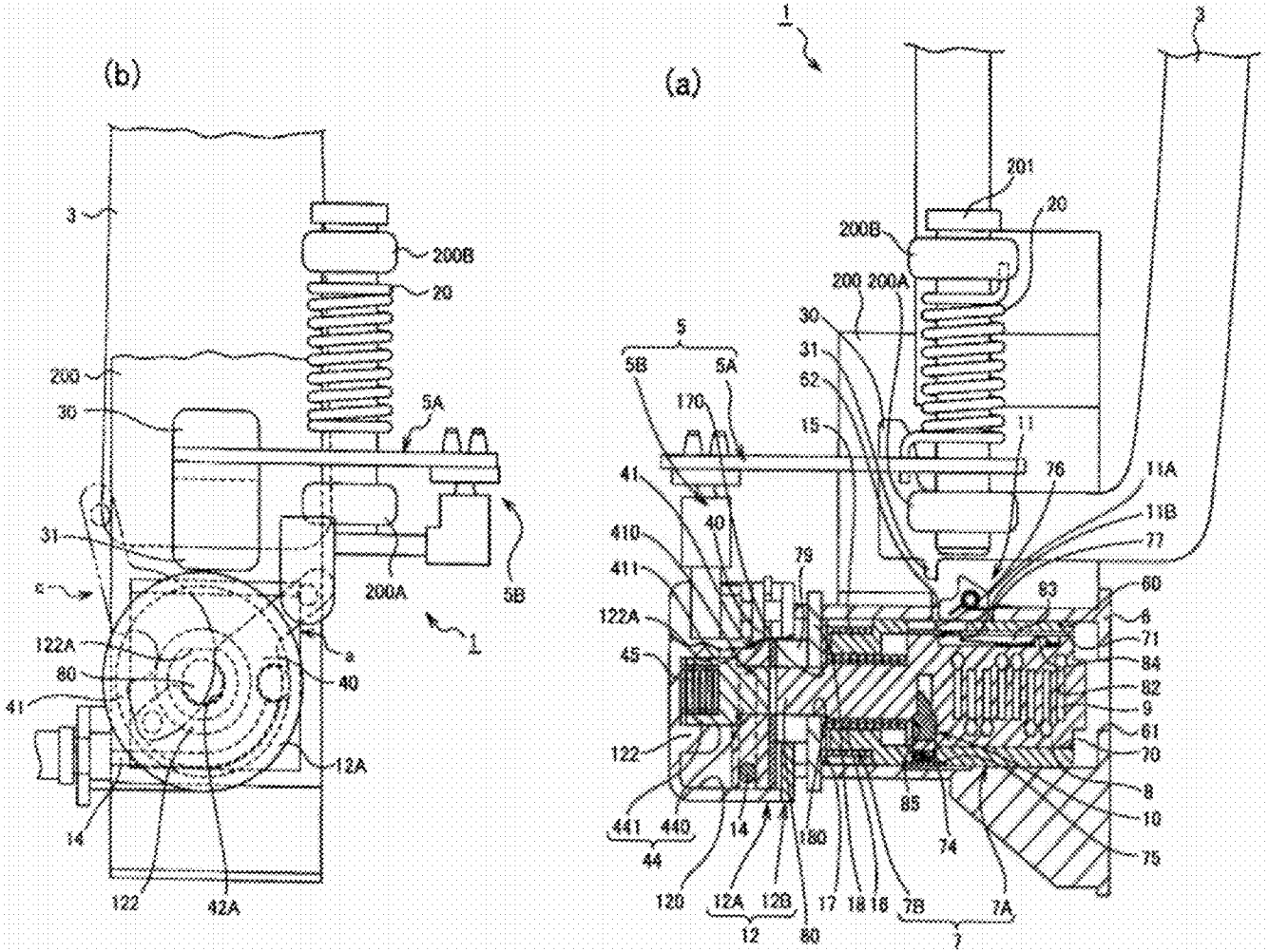
FIG. 11A and FIG. 11B are a cross sectional view and a rear view shown for explaining the operation when an unauthorized key is inserted into the cylinder lock of the unlocking device in the preferred embodiment according to the present invention.
Figure 12:
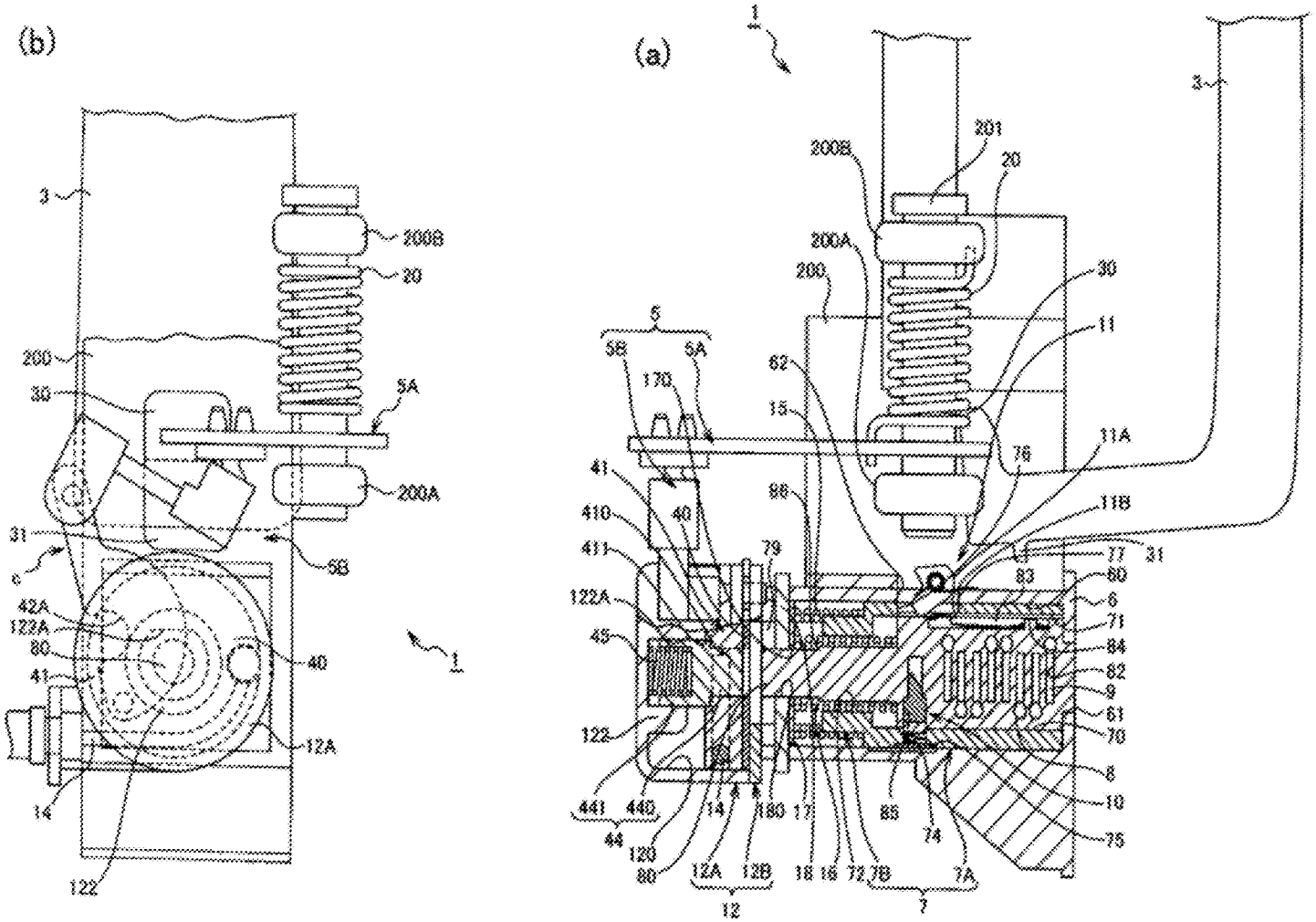
FIG. 12A and FIG. 12B are a cross sectional view and a rear view shown for explaining the operation when the operating handle is operated in the standby state of the unlocking device in the preferred embodiment according to the present invention.

FIG. 8A and FIG. 8B are views showing a standby state of the unlocking device in the preferred embodiment according to the present invention. FIG. 9A and FIG. 9B are views shown for explaining the operation when a matching key is inserted into a cylinder lock of the unlocking device in the preferred embodiment according to the present invention. FIG. 10A and FIG. 10B are views shown for explaining the operation when the operating handle of the unlocking device is operated in the preferred embodiment according to the present invention. FIG. 11A and FIG. 11B are views shown for explaining the operation when an unauthorized key is inserted into the cylinder lock of the unlocking device in the preferred embodiment according to the present invention. FIG. 12A and FIG. 12B are views shown for explaining the operation when the operating handle is operated in the standby state of the unlocking device in the preferred embodiment according to the present invention. In FIG. 8 to FIG. 12, A shows a cross sectional view and B shows a rear view, respectively.

In the locking state of the door locking mechanism, as shown in FIG. 8A and FIG. 8B, since the key plug 8 is arranged with the sleeve 7 on the key insert side of the body 6 (a housing space 60), the matching key is inserted into the key insert hole 81 of the key plug 8 so as to switch the door locking mechanism from a locking state to an unlocking state. In this case, when the matching key is inserted into the key insert hole 81 of the key plug 8, key fitting holes (not shown) of the tumblers 9, 9, - - - are engaged with corresponding convexes and concaves of the matching key respectively, and the tumblers 9, 9, - - - are withdrawn from the tumbler locking hole 73, 73, - - - of the sleeve 7 moving in the tumbler holding holes 82, 82, - - - of the key plug 8. In this case, since the tumblers 9, 9, - - - are arranged with the gaps G1 and G2 between an inner surface 73A of the tumbler locking holes 73, 73, - - - and a key insertion and extraction direction, it is possible to conduct a withdrawal movement of the tumblers 9, 9, - - - smoothly without interfering with the inner surface of the tumbler locking holes 73, 73, - - - when withdrawing the tumblers.

Furthermore, since the cam pin 10A (a cam face 102A) of the first key plug locking mechanism 10 is pressed in a key insertion direction by an end portion of the matching key inserted into the key insert hole 81, the cam pin 10A presses the lock pin 10B by withdrawing in a direction to separate from the axis line of the key insert hole 81. As a result, the lock pin 10B is embedded in the first through-hole 74 of the sleeve 7 and the locking state of the key plug 8 to the sleeve 7 by the lock pin 10B is released.

When the matching key is further inserted in a key insert direction in this state as shown in FIG. 9A and FIG. 9B, the key plug 8 proceeds from the key insert side to the key anti-insert side with respect to the sleeve 7. Consequently, the output portion 80 of the key plug 8 passes through the notch 42A of the input clutch element 40 and is also inserted into the round hole 410 of the output clutch element 41 (the main frame 42), and rotatably supports the input clutch element 40 and the output clutch element 41. In this case, a proceeding force of the key plug 8 is transmitted to a clutch stopper 43, the clutch stopper 44 moves to the key anti-insertion side against the resilient force of the spring 45 and the basal portion 441 is withdrawn from the D-shaped hole 411 of the output clutch element 41. As a result, the input clutch element 40 and the output clutch element 41 are allowed to pivot on the output portion 80 of the key plug 8.

Furthermore, since the locking piece 11B of the second key plug locking mechanism 11 (the spring deformed portion 113) is deformed into the locking portion by the proceeding of the key plug 8 in a key insert direction receiving a compressive force (a resilient force of the spring 11C) from the lever 11A (the press portion 111) of the second key plug locking mechanism 11 after releasing the pressed and connected state against the first receiving surface 77A of the spring receiving portion 77 and being elastically returned in the concave groove 83 of the key plug 8, the second through-hole 76, the first housing space 70 of the sleeve 7 and penetrating window 62 of the body 6, this elastically deformed spring deformed portion 113 (the locking portion) presses the second receiving surface 77B of the spring receiving portion 77 and the key plug 8 is locked into the sleeve 7. As a result, it is possible to detect the output status (a connecting state of the operating handle 3 and the door locking mechanism) of the key plug 8 (the output portion 80), and possible to stop the key insert operation while maintaining the state that the key plug 8 is locked into the sleeve 7.

Next, the pivotal (handle) operation of the operating handle 3 is conducted in a direction to unlock the door locking mechanism (a direction to open the door panel). In this case, when the pivotal operation of the operating handle 3 is conducted as shown in FIG. 10A, this pivotal operation force is transmitted from the first press portion 30 to the input clutch element 40 via the handle operation force transmission mechanism 5 (the transmitting lever 5A and the transmitting link 5B) and the input clutch element 40 pivots with the output clutch element 41 from position "a" indicated by broken lines in FIG. 8B to a position "b" indicated by broken lines in FIG. 10B (a position displaced at 105° from the position "a" turning around the key plug 8) and its pivoting force (a handle operation force) is transmitted to the door locking mechanism as an unlocking force via the wire 14. As a result, the door locking mechanism is released by receiving the unlocking force from the wire 14.

After this, when the pivotal operation of the operating handle 3 is conducted in a opening direction of the door panel in the unlocking state of the door locking mechanism, since the door locking mechanism is unlocked, the door panel is opened pivoting in an opening direction around the pivot bearing (the pin 32). Furthermore, when the lever 11A of the second key plug locking mechanism 11 receives the operation force of the operating handle 3 from the second press portion 31 via the operation force receiving portion 110 in the unlocking state of the door locking mechanism, since the lever 11A releases the locking state of the key plug 8 against the sleeve 7 by pivoting in a direction to release (from a locking portion to an unlocking portion) the pressure against the spring deformed portion 113 of the locking piece 11B, the key plug 8 moves and returns (withdraws) with the matching key by a resilient force of the spring 16 and is arranged on the key insert side (an initial position) in the sleeve 7.

Here, in the locking state of the door locking mechanism, for example, when an unauthorized key is inserted into the key insert hole 81 of the key plug 8, the key plug 8 moves with the sleeve 7 form the key insert side to the key anti-insertion side with respect to the body 6 as shown in FIG. 11A. In this case, since the sleeve 7 moves the input clutch element 40 and the output clutch element 41 by pressing in the key insertion direction, the input clutch element 40 and the output clutch element 41 are not supported on the output portion 80 of the key plug 8. When the input clutch element 40 receives the operation force of the operating handle 3 in a direction to unlock the door locking mechanism in this state, the input clutch element 40 does not transmit an oscillating force (a handle operation force) to the door locking mechanism by oscillating from the position "a" indicated by broken lines in FIG. 11B to a position "c" indicated by two-dot chain lines in FIG. 11B, as a result, the door locking mechanism is not unlocked.

Furthermore, when the key plug 8 moves in the key insertion direction with the sleeve 7 by an insertion of the unauthorized key into the key insert hole 81, the movement of the key plug 8 in a key insertion direction is restricted by contacting the key plug step-like surface 86 with the key insert side edge face of the spring stopper 17 prior to the sleeve 7, and it is possible to prevent a fracture generation of the tumblers 9, 9, - - - and the sleeve 7 avoiding the load due to the contact of the tumblers 9, 9, - - - received by the inner surface of the tumbler locking hole 73, 73, - - - .

In the locking state of the door locking mechanism, in case that the pivotal (handle) operation of the operating handle 3 is conducted in a direction to open the door panel, since the input clutch element 40 and the output clutch element 41 are not supported on the output portion 80 of the key plug 8 as shown in FIG. 12A, if the input clutch element 40 receives the operation force of the operating handle 3 from the handle operation force transmission mechanism 5 (the transmitting link 5B) in this state, the input clutch element 40 does not transmit an oscillating force (a handle operation force) to the door locking mechanism (the output clutch element 41) by oscillating as shown in FIG. 12B, as a result, the door locking mechanism is not unlocked.

EFFECT OF THE PREFERRED EMBODIMENT

According to the preferred embodiment described above, following effects can be obtained.

(1) Since a rod for a cylinder lock and a key lever mechanism which are conventionally required are not necessary, it is possible to reduce the number of parts assembled and possible to seek the simplification of the entire structure and the cost reduction.

(2) Since a rod for a cylinder lock and a key lever mechanism are not intermediated between the cylinder lock 2 and the clutch device 4, it is possible to lessen the outside dimension and possible to seek the miniaturization of the entire structure.

(3) Since the tumblers 9, 9, - - - are arranged with gaps G1 and G2 between the inner surface 73A of the tumbler locking holes 73, 73, - - - and the key insertion and extraction direction in the state that the key plug 8 is locked into the sleeve 7 by the first key plug locking mechanism 10, it is possible to conduct a withdrawal movement (an insert operation of the matching key) of the tumblers 9, 9, - - - smoothly without interfering with the inner surface 73A of the tumbler locking holes 73, 73, - - - when withdrawing the tumblers.

(4) Since the movement of the key plug 8 in a key insertion direction is restricted by contacting the key plug step-like surface 86 with the key insert side edge face of the spring stopper 17 prior to the sleeve 7 at the time of insertion of the unauthorized key into the key insert hole 81, it is possible to avoid the load due to the contact of the tumblers 9, 9, - - - received by the inner surface of the tumbler locking hole 73, 73, - - - and possible to prevent a fracture generation of the tumblers 9, 9, - - - and the sleeve 7.

(5) Since the locking piece 11B of the second key plug locking mechanism 11 is elastically deformed into the locking portion by the proceeding of the key plug 8 in a key insertion direction receiving a compressive force from the lever 11A, this elastically deformed locking piece 11B (the spring deformed portion 113) presses the second receiving surface 77B of the spring receiving portion 77 and the key plug 8 is locked into the sleeve 7. As a result, it is possible to detect the output status (a connecting state of the operating handle 3 and the door locking mechanism) of the key plug 8 and possible to stop the key insert operation while maintaining the state that the key plug 8 is locked into the sleeve 7.

Although the unlocking device according to the present invention has been described based on the above preferred embodiment, the invention is not limited by the above preferred embodiment and it is possible to implement in various features without going beyond a scope of the concept. For example, following variation can be made.

(1) In this preferred embodiment, although it is explained the structure in which the input clutch element 40 and the output clutch element 41 are arranged on the key insert side on the key plug axis line and the key anti-insert side respectively, the present invention is not limited thereto. Hence, it may be the structure in which the output clutch element and the input clutch element are arranged on the key insert side on the key plug axis line and the key anti-insert side, respectively.

(2) In this preferred embodiment, although it is the structure in which the joint of the cylinder lock 2 and the clutch device 4 is covered, the present invention is not limited thereto, hence, the joint may be covered by an armoring member. In this case, it is possible to prevent the intermittence of the clutch device 4 due to the external unauthorized act, hence, possible to prevent the occurrence of the vehicle theft.

(3) In this preferred embodiment, although it is explained that the unlocking of the door locking mechanism for the vehicle door panel is conducted, the present invention is not limited thereto. Hence, it may be the unlocking of the door locking mechanism for other door panels.

Although the invention has been described with respect to the specific embodiments for complete and clear disclosure, the appended claims are not to be therefore limited but are to be construed as embodying all modifications and alternative constructions that may occur to one skilled in the art which fairly fall within the basic teaching herein set forth.

What is claimed is:

1. A cylinder lock, comprising:

a sleeve; and a key plug housed in the sleeve and having an output portion to output an interrupted motion of a clutch device by moving in an insertion and extraction direction by an insertion and extraction of a matching key;

wherein the output portion of the key plug functions as a pivoting spindle that pivotally supports an input clutch element and an output clutch element of the clutch device when moved in an insertion direction relative to said sleeve into an output state by an insertion of the matching key, and wherein the key plug includes a polygonal section to fit inside of the sleeve so as to allow the key plug to move in the insertion direction and to prevent the key plug from rotating inside of the sleeve and, wherein the key plug is movable with the matching key in the insertion direction relative to said sleeve upon insertion of the matching key.

2. The cylinder lock according to claim 1, further comprising a key plug locking mechanism for locking the key plug into the sleeve in the output state of the output portion by an insertion of a matching key.

3. The cylinder lock according to claim 1, wherein a movement of the key plug in a key insertion direction is restricted at a predetermined position.

4. The cylinder lock according to claim 1, wherein the key plug moves in a key insertion direction with the sleeve by an insertion of an unauthorized key and the movement in a key insertion direction is restricted at a position preceding the position where the movement of the sleeve in a key insertion direction is restricted.

5. The cylinder lock according to claim 1, further comprising a key matching member movably supported in the key plug, wherein the key plug is locked into the sleeve in the state that said key matching member is inserted into a locking hole of the sleeve, a resilient force is imparted to said key matching member in a direction to insert said key matching member into the locking hole, and said key matching member is withdrawn from the locking hole to unlock the key plug by inserting the matching key into the key plug.

6. The cylinder lock according to claim 5, wherein the key matching member is arranged with a gap between an inner surface of the locking hole and a key insertion direction in the state that the key plug is locked into the sleeve.

7. The cylinder lock according to claim 1, wherein the key plug is housed in an interior of the sleeve.

8. The cylinder lock according to claim 1, wherein the key plug is housed in an inner wall of the sleeve.

* * * * *